US010429778B2

(12) United States Patent
Nishimura

(10) Patent No.: US 10,429,778 B2
(45) Date of Patent: Oct. 1, 2019

(54) IMAGE FORMING APPARATUS THAT DETERMINES A TYPE OF A RECORDING MATERIAL

(71) Applicant: CANON KABUSHIKI KAISHA, Tokyo (JP)

(72) Inventor: Naoki Nishimura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/108,782

(22) Filed: Aug. 22, 2018

(65) Prior Publication Data

US 2019/0064714 A1 Feb. 28, 2019

(30) Foreign Application Priority Data

Aug. 31, 2017 (JP) ..... 2017-167760

(51) Int. Cl.

*G03G 15/20* (2006.01)
*G03G 15/00* (2006.01)
*G03G 21/20* (2006.01)

(52) U.S. Cl.

CPC ..... *G03G 15/2039* (2013.01); *G03G 15/2017* (2013.01); *G03G 15/5029* (2013.01); *G03G 15/6502* (2013.01); *G03G 21/203* (2013.01); *G03G 2215/00776* (2013.01)

(58) Field of Classification Search

CPC ..... G03G 15/2039; G03G 15/2017
See application file for complete search history.

(56) References Cited

U.S. PATENT DOCUMENTS 6,229,120 B1 * 5/2001 Jewell ..... G03G 15/2003 219/216
2010/0158593 A1 * 6/2010 Clark ..... G03G 21/203 399/390

FOREIGN PATENT DOCUMENTS

JP 2006350200 A 12/2006
JP 2007276984 A 10/2007
JP 2009151021 A 7/2009
JP 2016102867 A 6/2016

* cited by examiner

*Primary Examiner* — Susan S Lee
(74) *Attorney, Agent, or Firm* — Canon U.S.A., Inc. IP Division

(57) ABSTRACT

An image forming apparatus includes a heat generation member to heat a recording material placed on a placement portion, an image forming unit, a detecting unit, a measuring unit, a storage unit, and a control unit. The image forming unit forms an image on the recording material conveyed from the placement portion. The detecting unit may detect information about a recording material characteristic. The measuring unit may measure a moisture content around the image forming apparatus as information. The storage unit stores information about a moisture content around the placement portion when the heat generation member is energized. When the heat generation member is not energized, the control unit sets an image forming condition based on an obtained detection result and measuring unit information. When the heat generation member is energized, the control unit sets the image forming condition based on the obtained detection result and the stored information.

12 Claims, 12 Drawing Sheets

IMAGE FORMING APPARATUS THAT DETERMINES A TYPE OF A RECORDING MATERIAL

BACKGROUND OF THE INVENTION

Field of the Invention

The present disclosure relates to an image forming apparatus that determines a type of a recording material and sets an image forming condition on the recording material in accordance with a result of the determination.

Description of the Related Art

Hitherto, there have been some image forming apparatuses, such as a copier and a printer, that include a sensor which performs detection for information about a physical characteristic (e.g., a grammage or a surface property) of a recording material and determine a type of the recording material from a result of the detection performed by the sensor. In such apparatuses, an image forming condition such as a transfer condition (e.g., a transfer voltage or a conveyance speed of the recording material at a time of being transferred) or a fixing condition (e.g., a fixing temperature or a conveyance speed of the recording material at a time of being fixed) is set in accordance with a result of the determination of the type of the recording material, so that an image quality is refined.

In Japanese Patent Laid-Open No. 2016-102867, by focusing on a characteristic of a recording material varying in accordance with a moisture content contained in the recording material, a detection result obtained by a sensor is corrected based on a moisture content in air, which is obtained from a temperature and a humidity around an image forming apparatus. For example, when the moisture content in the air is high under a high-temperature and high-humidity environment, the moisture content contained in the recording material is also expected to be high. Then, when the moisture content contained in the recording material is high, a grammage of the recording material increases in accordance with the moisture content. The image forming apparatus is able to determine the grammage of the recording material more accurately by correcting the detection result obtained by the sensor while considering such a moisture content of the recording material.

However, in a case where image formation is performed in a state where the moisture content contained in the recording material is high, particularly when the recording material is heated through processing of fixing an image, the recording material is likely to be curled as the moisture contained in the recording material evaporates. Thus, a configuration in which a heater is provided in a part of a sheet feeding port to heat the recording material so that moisture absorption of the recording material is suppressed and curl of the recording material is suppressed is known.

With this configuration, the temperature and the humidity around the image forming apparatus are greatly different from a temperature and a humidity near the sheet feeding port, so that it is difficult to estimate the moisture content of the recording material based on the moisture content in the air as in Japanese Patent Laid-Open No. 2016-102867. As a result, accuracy of determination of the grammage of the recording material is lowered and the image forming condition is erroneously set, so that there is a possibility that an image quality is deteriorated.

SUMMARY OF THE INVENTION

The present disclosure provides an image forming apparatus in which a heater is provided in a sheet feeding port, and which determines a type of a recording material with high accuracy and forms an image with high quality.

According to an aspect of the present disclosure, an image forming apparatus includes a heat generation member configured to heat a recording material placed on a placement portion, an image forming unit configured to form an image on the recording material conveyed from the placement portion, a detecting unit configured to perform detection for information about a characteristic of the recording material, a measuring unit configured to perform measurement for information about a moisture content around the image forming apparatus, a storage unit configured to store information about a moisture content around the placement portion in a state where the heat generation member is energized, and a control unit configured to set an image forming condition, in which, in a case where the heat generation member is not energized, the control unit sets an image forming condition for the image forming unit based on a detection result obtained by the detecting unit and the information obtained by the measuring unit, and, in which, in a case where the heat generation member is energized, the control unit sets the image forming condition based on the detection result obtained by the detecting unit and the information stored in the storage unit.

Further features of the present disclosure will become apparent from the following description of embodiments with reference to the attached drawings.

DESCRIPTION OF THE EMBODIMENTS

[Embodiment 1]

<Explanation of Image Forming Apparatus>

Figure 1:
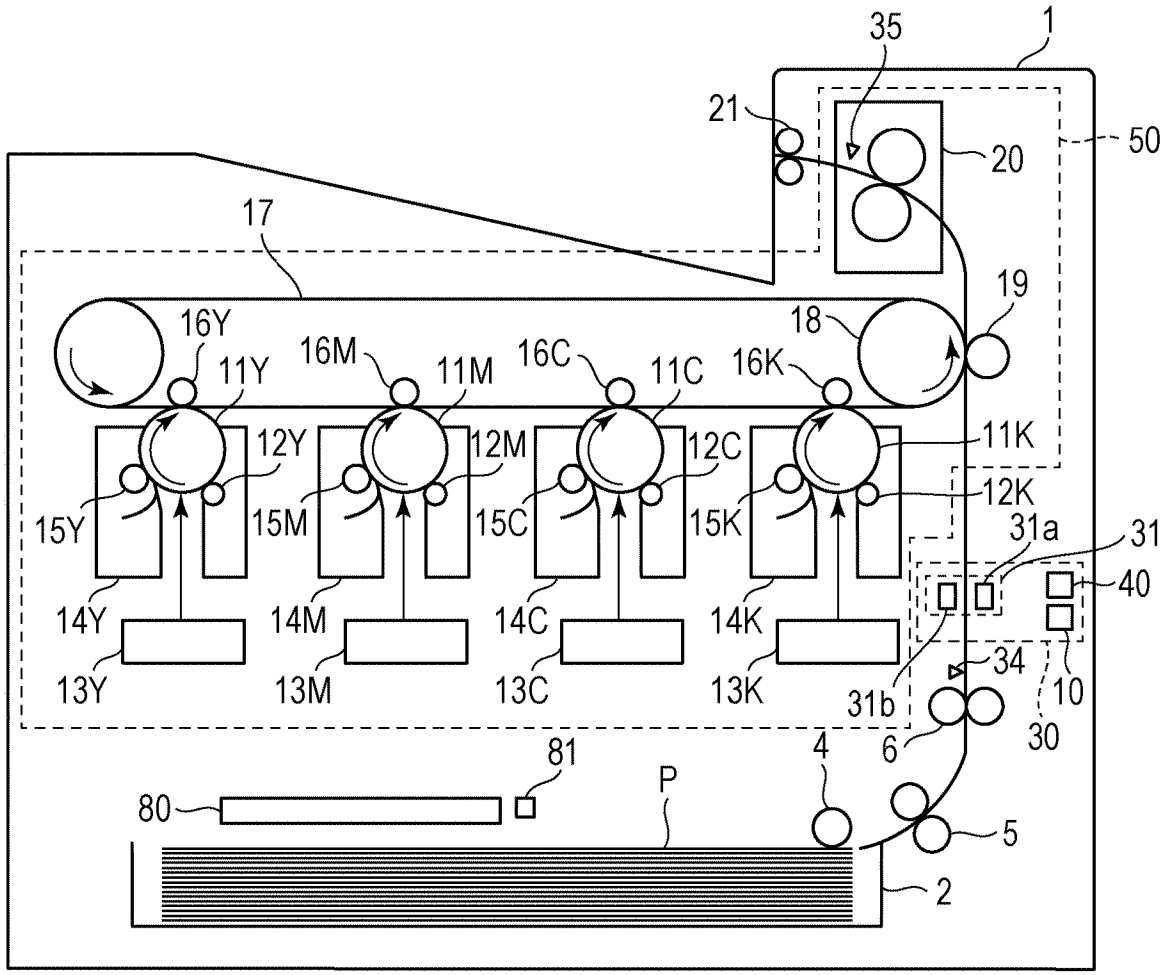
FIG. 1 illustrates an example of an image forming apparatus.

A laser beam printer 1 (hereinafter, referred to as a printer 1) of an electrographic system to which the present embodiment is applicable will be described. FIG. 1 is a schematic configuration diagram of the printer 1. The printer 1 is a tandem color laser beam printer and is able to form a color image on a sheet P (recording material) by superimposing toner in four colors of yellow (Y), magenta (M), cyan (C), and black (K) serving as developer. A feeding cassette 2 is an example of a placement portion and a plurality of sheets P are placed thereon. In the feeding cassette 2, a cassette heater 80 and an energization detecting sensor 81 are provided. The cassette heater 80 heats a periphery of each of the sheets P placed on the feeding cassette 2 so that moisture absorption of the sheet P is suppressed. The energization detecting sensor 81 detects whether or not the cassette heater 80 is in an energized state. On a conveyance path of the sheet P, a feeding roller 4 that feeds the sheet P from the feeding cassette 2, a conveyance roller pair 5 that conveys the sheet P fed from the feeding cassette 2, and a registration roller pair 6 are provided. Moreover, a registration sensor 34 for detecting a conveying state of the sheet P and a fixing sheet discharge sensor 35 are provided. A recording material determination apparatus 30 performs detection for information about a characteristic of the sheet P which is conveyed from the feeding cassette 2 and determines a type of the sheet P. Details of the recording material determination apparatus 30 will be described below.

Photosensitive drums 11 (11Y, 11M, 11C, and 11K) bear toner of respective colors. Charging rollers 12 (12Y, 12M, 12C, and 12K) for the respective colors uniformly charge the photosensitive drums 11 at a predetermined potential. Laser scanners 13 (13Y, 13M, 13C, and 13K) are laser scanners for four colors. Additionally, process cartridges 14 (14Y, 14M, 14C, and 14K) visualize electrostatic latent images formed on the photosensitive drums 11. Development rollers 15 (15Y, 15M, 15C and 15K) feed toner in the process cartridges 14 to the photosensitive drums 11. Primary transfer rollers 16 (16Y, 16M, 16C, and 16K) primarily transfer toner images formed on the photosensitive drums 11 onto an intermediate transfer belt 17. The intermediate transfer belt 17 is rotated by a driving roller 18. A secondary transfer roller 19 transfers the toner images formed on the intermediate transfer belt 17 onto the sheet P. A fixing unit 20 melts and fixes the toner images which are secondarily transferred onto the sheet P while conveying the sheet P. The respective components from the photosensitive drums 11 to the fixing unit 20 described above constitute an example of an image forming unit 50. A discharge roller 21 discharges the sheet P on which fixing is performed by the fixing unit 20.

<Configuration of Recording Material Determination Apparatus>

Figure 2:
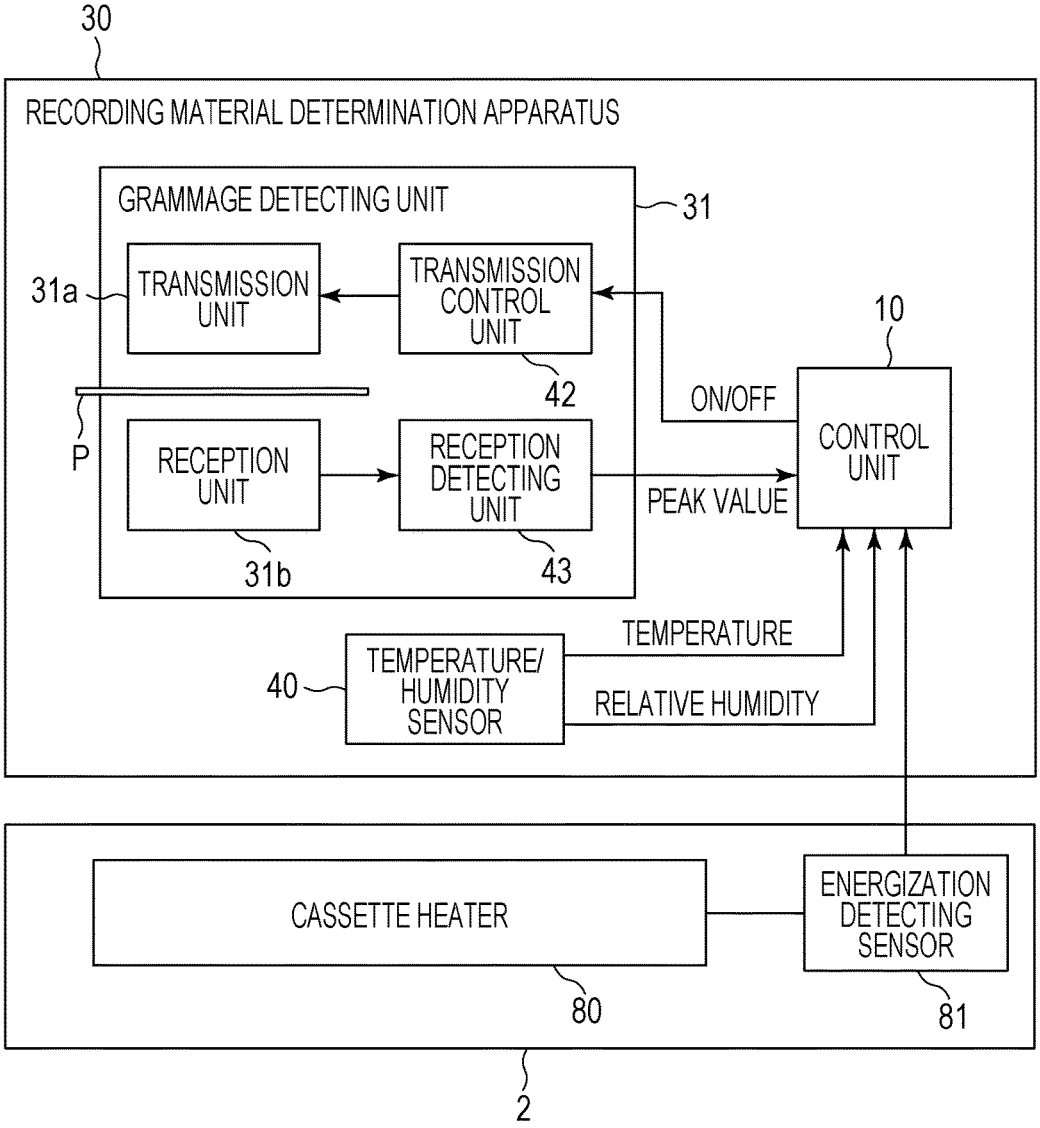
FIG. 2 illustrates an example of a recording material determination apparatus according to Embodiment 1.

A configuration of the recording material determination apparatus 30 to which the present embodiment is applicable will be described. FIG. 2 illustrates an example of the configuration of the recording material determination apparatus 30 and a configuration of the feeding cassette 2. The recording material determination apparatus 30 is constituted by a temperature/humidity sensor 40, a grammage detecting unit 31, and a control unit 10, which are described below. The temperature/humidity sensor 40 (measuring unit) measures a temperature and a humidity around the printer 1 in order to obtain a moisture content in air around the printer 1. Note that, though description is given with use of the temperature/humidity sensor 40 in the present embodiment, there is no limitation thereto as long as the moisture content in the air is able to be detected. The temperature/humidity sensor 40 may be prearranged in a place that is near an exterior of the printer 1 and that is not influenced by a heat source so that the temperature and humidity environment around the printer 1 is able to be accurately detected.

The grammage detecting unit 31 is an ultrasonic sensor for detecting a grammage of the sheet P conveyed from the feeding cassette 2. Here, the grammage indicates a mass of the sheet P per unit area and is expressed in the unit of [g/m$^2$]. For simplification, the unit of grammage is also expressed as [g]. The grammage detecting unit 31 is constituted by an ultrasonic wave transmission unit 31*a* and an ultrasonic wave reception unit 31*b* (hereinafter, referred to as a transmission unit 31*a* and a reception unit 31*b*, respectively). The control unit 10 is constituted by a microprocessor (MPU) (not illustrated) that includes a CPU, a memory, and the like. The control unit 10 controls the grammage detecting unit 31, performs processing of a detection result of the temperature/humidity sensor 40 and a detection result of the energization detecting sensor 81, and also has a function of controlling the printer 1. The control unit 10 sets an image forming condition (print mode) in accordance with a type of the sheet P based on the detection result of the temperature/humidity sensor 40, the detection result of the energization detecting sensor 81, and a detection value of the grammage detecting unit 31. Here, the image forming condition indicates various process conditions when the image forming unit 50 forms an image on the sheet P and details thereof will be described below.

In the present embodiment, the control unit 10 collectively performs control of the grammage detecting unit 31, processing of the detection results of the temperature/humidity sensor 40 and the energization detecting sensor 81, and control of an electrographic process, but control units separate from each other may be provided so that the respective functions are shared. For example, a control unit that performs the control of the grammage detecting unit 31 and the processing of the detection results of the temperature/humidity sensor 40 and the energization detecting unit 81 may be provided separately from a control unit that performs the control of the electrographic process, and the control units may mutually share the control and detection values with each other by communication. For example, a control unit that performs the control of the grammage detecting unit 31 may be provided separately from a control unit that performs the processing of the detection results of the temperature/humidity sensor 40 and the energization detecting sensor 81 and the control of the electrographic process, and the control units may mutually share the control and the detection values with each other by communication.

<Configuration of Cassette Heater 80>

Figure 3:
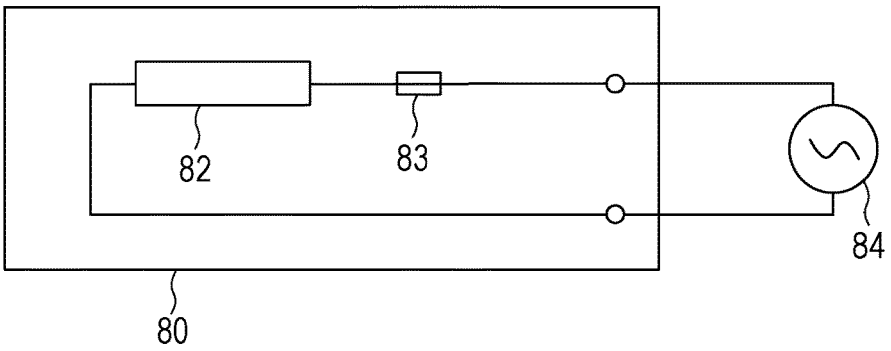
FIG. 3 illustrates an example of a cassette heater according to Embodiments 1 and 2.

FIG. 3 illustrates an example of the cassette heater 80 to which the present embodiment is applicable. The cassette heater 80 (heat generation member) is constituted by a resistor 82 and a fuse 83 and connected to an external power supply 84 such as a commercial power supply. When power supplied from the external power supply 84 is consumed by the resistor 82, the resistor 82 generates heat. Thereby, a temperature inside the feeding cassette 2 rises. The fuse 83 prevents an unexpected overcurrent from flowing through the resistor 82. In the present embodiment, though a configuration in which the external power supply 84 supplies power to the resistor 82 is indicated as an example, another method may be used. For example, a configuration in which a power supply of the printer 1 supplies power to the resistor 82 may be provided.

<Effect of Cassette Heater 80>

Figure 4:
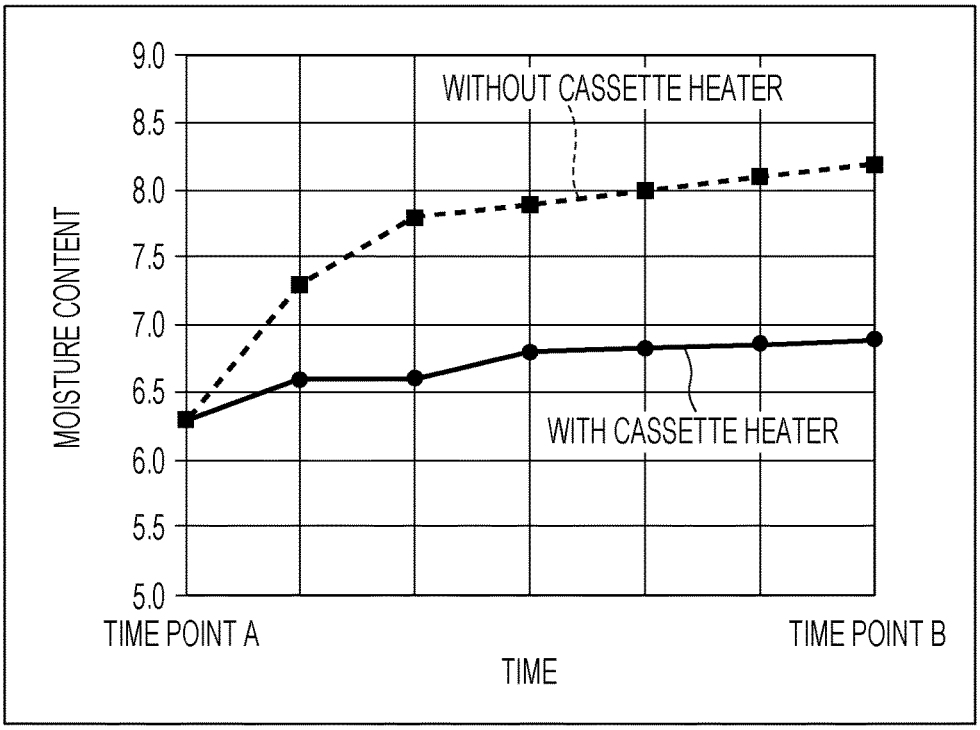
FIG. 4 is a graph indicating a relation between an energization state of the cassette heater and a moisture content of a recording material.

When the sheet P that is left under a high humidity environment is printed, since the sheet P absorbs a large amount of moisture, the sheet P that is printed is curled. As a countermeasure against the curl, there is a method in which the cassette heater 80 is mounted in the feeding cassette 2 so that a humidity inside the feeding cassette 2 is lowered. FIG. 4 illustrates an example of measurement data obtained through examination by inventors and indicates change in a moisture content of the sheet P with time under the high humidity environment (a temperature of 32.5° C. and a relative humidity of 80%). The moisture content of the sheet P at a timing (time point A) when the sheet P is unpacked from a package is 6.3%. When there is no cassette heater 80, the sheet P absorbs the moisture in the air and the moisture content of the sheet P rises up to 8.1% at a time point B. On the other hand, when there is the cassette heater 80, since the humidity inside the feeding cassette 2 is low, the moisture content of the sheet P rises only to 7.0% at the time point B. In this manner, by mounting the cassette heater 80, it is possible to suppress the moisture absorption of the sheet P even under the high humidity environment and suppress the curl.

<Operation of Recording Material Determination Apparatus>

An operation of the recording material determination apparatus 30 to which the present embodiment is applicable will be described with use of FIG. 2. As described above, the control unit 10 detects the temperature and the relative humidity around the printer 1 by the temperature/humidity sensor 40 and obtains the moisture content in the air around the printer 1. The moisture content in the air is able to be obtained from a saturated vapor amount with respect to the temperature, which is stored in a ROM of the control unit 10 or the like.

The grammage detecting unit 31 is constituted by the transmission unit 31*a* that transmits an ultrasonic wave and the reception unit 31*b* that receives the ultrasonic wave. The transmission unit 31*a* and the reception unit 31*b* have similar configurations and are constituted by a piezoelectric element serving as interconversion element of a mechanical displacement and an electrical signal and an electrode terminal. When the sheet P is conveyed to a portion between the transmission unit 31*a* and the reception unit 31*b*, the control unit 10 gives an instruction to start an operation to a transmission control unit 42. Under control of the transmission control unit 42, the transmission unit 31*a* transmits an ultrasonic wave of a specific frequency to the sheet P. The reception unit 31*b* functions to receive the ultrasonic wave that is transmitted through the sheet P. A reception detecting unit 43 outputs, as a detection value, a voltage of a peak value (amplitude value) of a waveform that is received to an AD port of the control unit 10. The control unit 10 receives the output of the reception detecting unit 43 by the AD port of a CPU (not illustrated). The AD port of the control unit 10 is able to detect a voltage with a resolution of 256 division levels by using a power supply voltage input to the control unit 10 as a reference and performs conversion into a dec value by detecting how many times the voltage input to the AD port is greater than the resolution, and decides the dec value as a detection value. For example, when the power supply voltage of the control unit 10 is 3.3 V and the dec value is 128, the voltage input to the AD port is 1.65 V. Note that, though the description has been given with use of the 256 division levels in the present embodiment, this is merely an example.

After receiving the detection value, the control unit 10 gives an instruction to stop the operation to the transmission control unit 42. The ultrasonic wave transmitted through the sheet P is attenuated in accordance with an increase of the grammage of the sheet P. In a case of the sheet P with a small grammage (thin paper), an attenuation amount of the ultrasonic wave is small and a peak value and a detection value of the control unit 10 are large. On the other hand, in a case of the sheet P with a large grammage (thick paper), the attenuation amount of the ultrasonic wave is large and the peak value and the detection value of the control unit 10 are small. Accordingly, the type of the sheet P (also referred to as a paper type) is able to be determined as thin paper when the detection value of the control unit 10 is large, and as thick paper when the detection value of the control unit 10 is small. In general, while a grammage of plain paper is 115 g or less, a grammage of coated paper often exceeds 115 g. Therefore, as an example, the peak value when the grammage detecting unit 31 detects the sheet P with the grammage of 115 g is set so that the detection value is 90 dec as a value of 256 division levels. Thereby, when the detection value is 90 dec or more, the paper type is determined as plain paper. In the present embodiment, a threshold of the detection value for determining a paper type is set to 90 dec, but is able to be freely set in accordance with a predetermined paper type that is to be determined. As an example, in general, a grammage of thin paper is often 70 g or less. The detection value when the grammage detecting unit 31 detects the sheet P with the grammage of 70 g is set as 150 dec by the AD port of the control unit 10, and thereby the paper type is determined as thin paper when the detection value is 150 dec or more.

Subsequently, the paper type and the image forming condition will be described. In general, a resistance value of the sheet P varies depending on the grammage of the sheet P and a transfer condition for transferring toner, such as a transfer voltage, may be changed accordingly. Moreover, heat capacity varies depending on the grammage of the sheet P and a fixing condition for fixing toner, such as a fixing temperature, a fixing time, or a conveyance speed, may be changed accordingly. Thus, to refine an image quality, the image forming condition, such as the transfer condition or the fixing condition, is appropriately set in accordance with the paper type. For example, in a case of the sheet P with a small grammage such as thin paper, by setting the fixing temperature to be low, power that is required is reduced, and on the other hand, in a case of the sheet P with a large grammage such as thick paper, by setting the fixing temperature to be high or lowering the conveyance speed of the sheet P, fixability is refined.

Next, the moisture content of the sheet P and the image forming condition will be described. The resistance value of the sheet P or the grammage of the sheet P changes depending on the moisture content and the image forming condition may be set accordingly. Moreover, the change in the resistance value of the sheet P according to the moisture content varies depending on the paper type. Thus, the image forming condition according to the paper type and the moisture content is set, so that optimum image formation is able to be performed.

<Correction of Detection Value when Cassette Heater 80 is not Energized>

Influence that the moisture content has on determination of a paper type will be described. When the moisture content of the sheet P is high, a moisture content contained in fibers constituting the sheet P increases, and thus the grammage of the sheet P increases due to the contained moisture content. On the other hand, when the moisture content is low, a moisture content contained in the fibers constituting the sheet P decreases, and thus the grammage of the sheet P decreases. Therefore, when the paper type is determined based on a detection value of the grammage that changes due to the moisture content, there is a possibility that a paper type of the sheet P is erroneously determined. Accordingly, correction may be performed in accordance with the moisture content of the sheet P to obtain a predetermined determination accuracy.

The moisture content of the sheet P is correlated with a moisture content in the air near the sheet P, that is, a moisture content in the air near the feeding cassette 2 on which the sheet P is placed. Moreover, in the present embodiment, the moisture content in the air near the feeding cassette 2 is handled as being the same as the moisture content in the air around the printer 1, which is obtained by the temperature/humidity sensor 40. In the present embodiment, description will be given by taking an absolute moisture content (moisture content per unit volume) which is obtained based on a temperature and a humidity as an example of the moisture content, and an environment in which the absolute moisture content is about 11.5 g (corresponding to a temperature of 25° C. and a humidity of 50% RH) is set as a reference environment. Note that, in the present embodiment, description will be given by taking the absolute moisture content as an example, but there is no limitation thereto as long as the moisture content contained in the sheet P is able to be estimated. As an example, the moisture content contained in the sheet P is able to be estimated from a moisture content obtained based on the relative humidity. For example, in a case of use within a temperature range in which change in the moisture content is small, the moisture content contained in the sheet P may be estimated based on the relative humidity around the sheet P, and the estimation is able to be performed with accuracy equivalent to that of the absolute moisture content obtained based on a temperature and a humidity.

Figure 5:
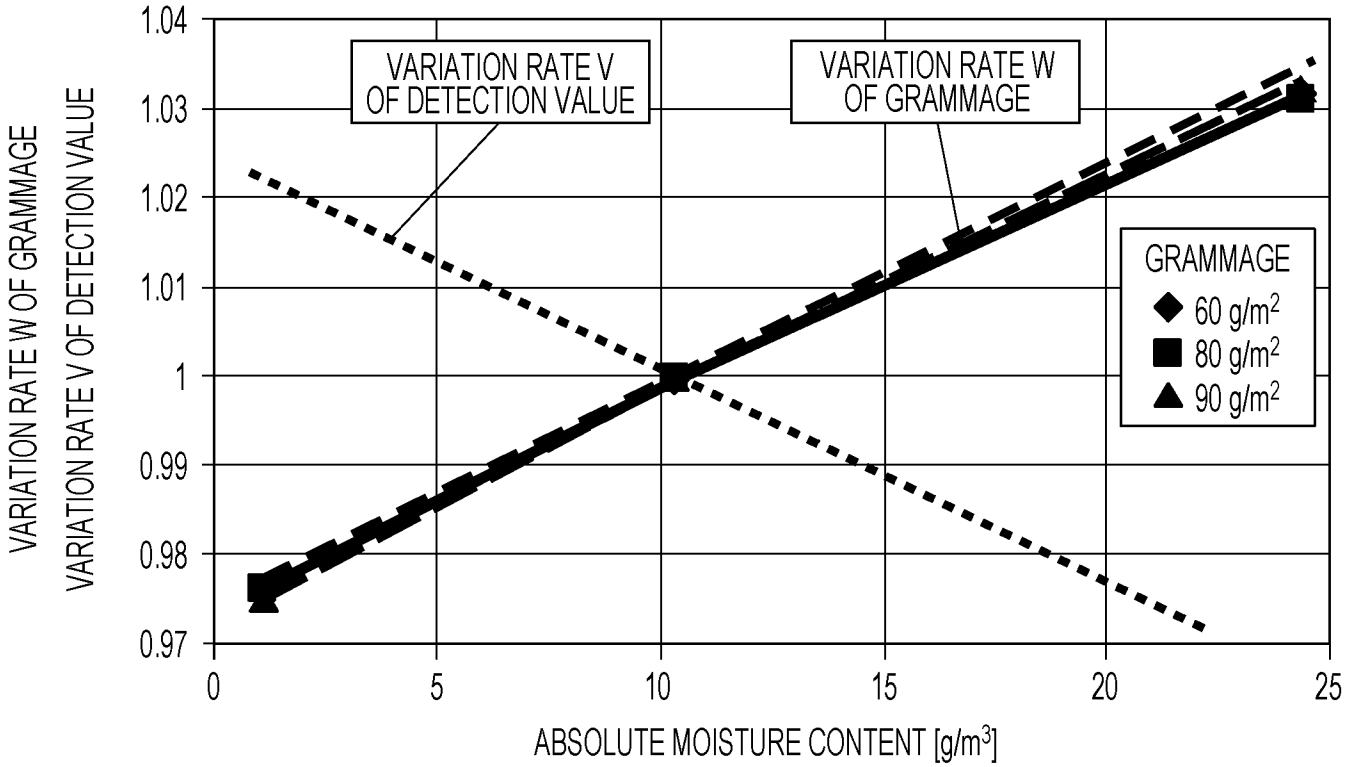
FIG. 5 is a graph indicating an example of a relation between a moisture content and a detection value according to Embodiment 1.

Next, influence that variation in the absolute moisture content detected based on the detection result of the temperature/humidity sensor 40 has on the detection value of the grammage detecting unit 31 will be described with use of experimental results of the inventors, which are illustrated in FIG. 5. As described above, in order to estimate the moisture content contained in the sheet P, in the present embodiment, the absolute moisture content that is obtained by the temperature/humidity sensor 40 is used as an example. A horizontal axis of FIG. 5 indicates the absolute moisture content based on the detection result of the temperature/humidity sensor 40. A vertical axis of FIG. 5 indicates a variation rate W of the grammage of the sheet P and a variation rate V of the detection value of the grammage detecting unit 31 when the environment in which the absolute moisture content is about 11.5 g (corresponding to a temperature of 25° C. and a humidity of 50% RH) is set as a reference environment. Here, as an example, sheets P (plain paper) with grammages of 60 g, 80 g, and 90 g are indicated, and measurement is executed after each of the sheets P is sufficiently left and adapted to the temperature and humidity environment at a time of the measurement. As described above, since the grammage increases or decreases in accordance with increase or decrease of the absolute moisture content, the absolute moisture content and the variation rate W are in proportion to each other as illustrated in FIG. 5. Additionally, as described above, when the grammage of the sheet P increases, the detection value of the grammage detecting unit 31 becomes small. Accordingly, an inverse number of the variation rate W of the grammage is the variation rate V of the grammage detecting unit 31. When the absolute moisture content is able to be detected, by using an approximate formula of the variation rate V obtained from FIG. 5, it is possible to estimate the variation rate V of the detection value of the grammage detecting unit 31, which varies due to the absolute moisture content. By dividing the detection value by the estimated variation rate V, the detection value is able to be corrected to a detection value under the same reference environment.

For example, as illustrated in FIG. 5, the grammage of the sheet P under an environment in which the absolute moisture content is 20 g is about 1.022 times as much as the grammage under the reference environment in which the absolute moisture content is 11.5 g. Accordingly, the detection value of the grammage detecting unit 31 under the environment in which the absolute moisture content is 20 g is about 0.978 (=1/1.022) times as much as the detection value of the grammage detecting unit 31 under the reference environment in which the absolute moisture content is 11.5 g. Thus, by dividing the detection value of the grammage detecting unit 31 under the environment in which the absolute moisture content is 20 g by 0.978, the detection value of the grammage detecting unit 31 under the environment in which the absolute moisture content is 20 g is able to be converted into the detection value of the grammage detecting unit 31 under the reference environment in which the absolute moisture content is 11.5 g. That is, the detection value of the grammage detecting unit 31 under a certain environment is divided by the variation rate V under the environment, so that the detection value of the grammage detecting unit 31 is corrected to a value under the reference environment in which the absolute moisture content is about 11.5 g (corresponding to a temperature of 25° C. and a humidity of 50% RH).

Additionally, as for the paper types (plain paper) with the grammages illustrated in FIG. 5, it is found that variation in the variation rate V is small regardless of a difference between the grammages. Thus, in the paper types with small deference in the grammage, the variation rate V is able to be approximated with high accuracy without changing an approximate formula in accordance with the paper type. In the case of the present embodiment, by substituting the moisture content obtained by the temperature/humidity sensor 40 in the following approximate formula 1, the variation rate V of the detection value of the grammage detecting unit 31 is obtained. As described above, a coefficient of the approximate formula 1 is calculated by performing approximation based on the variation rate V of the detection value with respect to the moisture content of the sheet P with the grammage of 80 g in FIG. 5.

$$\text{Variation rate } V = 1/(0.03 \times \text{moisture content}[g] + 0.98) \qquad \text{approximate formula 1}$$

Here, the approximate formula 1 of the variation rate V is an example in the present embodiment and may be appropriately set in accordance with a detection characteristic of the grammage detecting unit 31. Moreover, as described above, in the present embodiment, the moisture content in the air near the feeding cassette 2 is handled as being the same as the moisture content in the air around the printer 1, which is obtained by the temperature/humidity sensor 40. In general, a placement portion such as the feeding cassette 2, a manual feeding tray (not illustrated), or an optional feeding cassette (not illustrated) is provided at a place that is not significantly influenced by a heat source such as a power supply or a driving source of the printer 1. Thus, it is able to be considered that the moisture content in the air near the feeding cassette 2 is almost equal to that around the printer 1.

<Correction of Detection Value when Cassette Heater 80 is Energized>

On the other hand, when the cassette heater 80 is energized, a temperature and a humidity near the feeding cassette 2 are different from a temperature and a humidity near the printer 1. That is, a moisture content of the sheet P that is estimated from the moisture content which is obtained from the temperature and the humidity near the printer 1 is different from an actual moisture content of the sheet P. Accordingly, the moisture content near the feeding cassette 2 is not able to be handled as being the same as the moisture content near the printer 1 as in the case of the correction of the detection value when the cassette heater 80 is not energized as described above. Then, when determining that the cassette heater 80 is energized based on the detection result of the energization detecting sensor 81, the control unit 10 calculates the moisture content near the feeding cassette 2 based on fixed temperature and humidity information that is stored in the control unit 10 in advance. The fixed temperature and humidity information is a value that is examined and decided in advance and is a temperature and a humidity near the feeding cassette 2 when the cassette heater 80 is used under an environment close to an actual use environment. For example, when the cassette heater 80 is used under a high-temperature and high-humidity environment (32.5° C. and 80%), "the temperature of 38° C. and the humidity of 58%" is stored in a storage unit such as a ROM in advance as the fixed temperature and humidity information. The control unit 10 calculates the moisture content near the feeding cassette 2 from the fixed temperature and humidity information and calculates the variation rate V based on the moisture content. Moreover, information of a moisture content itself obtained from the fixed temperature and humidity information may be stored instead of the fixed temperature and humidity information. Since subsequent correction of the detection value is the same as the correction of the detection value when the cassette heater 80 is not energized, description thereof will be omitted.

As above, in the present embodiment, the detection value is corrected based on the moisture content obtained by the detection result of the temperature/humidity sensor 40, but a correcting method is not limited as long as a result of determination of a paper type according to a moisture content is able to be obtained. For example, a correction target may not be the detection value, and a similar effect is achieved also by changing a threshold of the detection value to determine a paper type. An example of the threshold corresponds to 90 dec that is a threshold of plain paper and coated paper. By increasing or decreasing the value of 90 dec based on the moisture content that is detected, it is possible to determine a paper type according to the moisture content without correcting the detection value. As a method other than the method of correcting the detection value or the threshold, it is also possible to store a table, which indicates a relation between the moisture content near the feeding cassette 2 and the detection value, in the control unit 10 to determine the paper type from the moisture content and the detection value that are obtained, and an effect similar to that of the present embodiment is able to be obtained. An example of the table includes a table in which, when the moisture content is 11.5 g and the detection value is 116 g, the paper type is determined as plain paper, and when the moisture content is 5 g and the detection value is 116 g, the paper type is determined as coated paper.

<Explanation of Flowchart>

Figure 6:
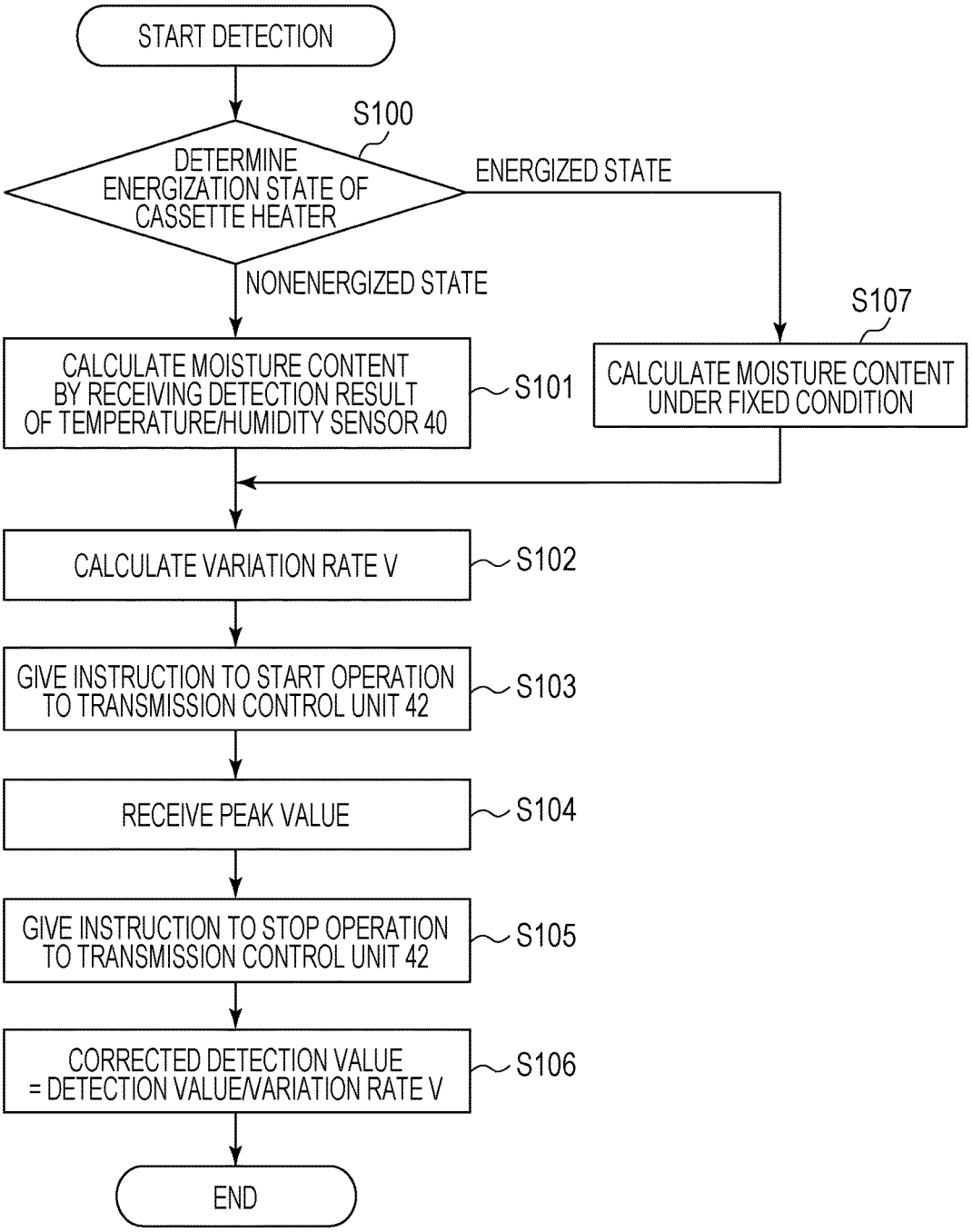
FIG. 6 illustrates an example of a flowchart of a method of determining a recording material according to the Embodiment 1.

An operation of the present embodiment will be described with a flowchart of FIG. 6. The control unit 10 determines an energization state of the cassette heater 80 based on a detection result of the energization detecting sensor 81 (S100). When determining that the cassette heater 80 is in an nonenergized state, the control unit 10 obtains a moisture content from a detection result of the temperature/humidity sensor 40 (S101), and calculates a variation rate V of the detection value from the obtained moisture content by using the approximate formula 1 (S102). Next, the control unit 10 gives an instruction to start an operation to the transmission control unit 42 (S103), and receives, from the reception detecting unit 43, a peak value of a received waveform of an ultrasonic wave transmitted through the sheet P (S104). Thereafter, the control unit 10 gives an instruction to stop the operation to the transmission control unit 42 (S105). The peak value of the received waveform is detected by the AD port of the control unit 10 and input to the control unit 10 as a detection value of the grammage detecting unit 31. By dividing the detection value by the variation rate V, the control unit 10 obtains the value as a corrected detection value (S106). When determining that the cassette heater 80 is in an energized state at S100, the control unit 10 calculates a moisture content under a fixed condition stored in advance (S107), and calculates a variation rate V of the detection value from the obtained moisture content by using the approximate formula 1 (S102). Since steps after the step (S102) are performed in the same manner as the flow when the cassette heater 80 is determined to be in the nonenergized state, description thereof will be omitted.

According to the present embodiment, the configuration and the operation described above achieve the following effect. The recording material determination apparatus 30 estimates change in the grammage of the sheet P based on the moisture content obtained from the detection result of the temperature/humidity sensor 40, so that it is possible to refine accuracy of determination of a paper type. For example, it is possible to discriminate paper types with difference in the grammage of about 10 g or less, such as paper types with grammages of 70 g and 80 g, which are not able to be clearly discriminated in the related art due to variation in the moisture content. As a result, the printer 1 that includes the recording material determination apparatus 30 is able to appropriately set an image forming condition according to the determined paper type, so that it is possible to refine an image quality. Additionally, as an example of a method of obtaining an optimum image forming condition, a relation of a moisture content, a detection value, and an image forming condition is saved in the control unit 10, and with the obtained relation of the moisture content and the detection value, it is also possible to decide the image forming condition without determining a paper type.

In the present embodiment, the temperature/humidity sensor 40 that detects the moisture content near the printer 1 is used to obtain the moisture content near the feeding cassette 2, but the method is not limited thereto as long as the moisture content near the feeding cassette 2 is obtained.

In the present embodiment, the control unit 10 determines an energization state of the cassette heater 80 based on the detection result of the energization detecting sensor 81, but the method is not limited thereto. For example, there is also a method in which a user or a service person inputs a state of the cassette heater 80 to the control unit 10. By this method, the control unit 10 may determine the energization state of the cassette heater 80 based on information that is input.

[Embodiment 2]

<Configuration and Operation of Recording Material Determination Apparatus>

A printer 1 to which the present embodiment is applicable has the same configuration as that of the printer 1 described in Embodiment 1 excluding the recording material determination apparatus 30. Accordingly, in the present embodiment, description of the recording material determination apparatus 30 will be given and description of other common parts will be omitted.

Figure 7:
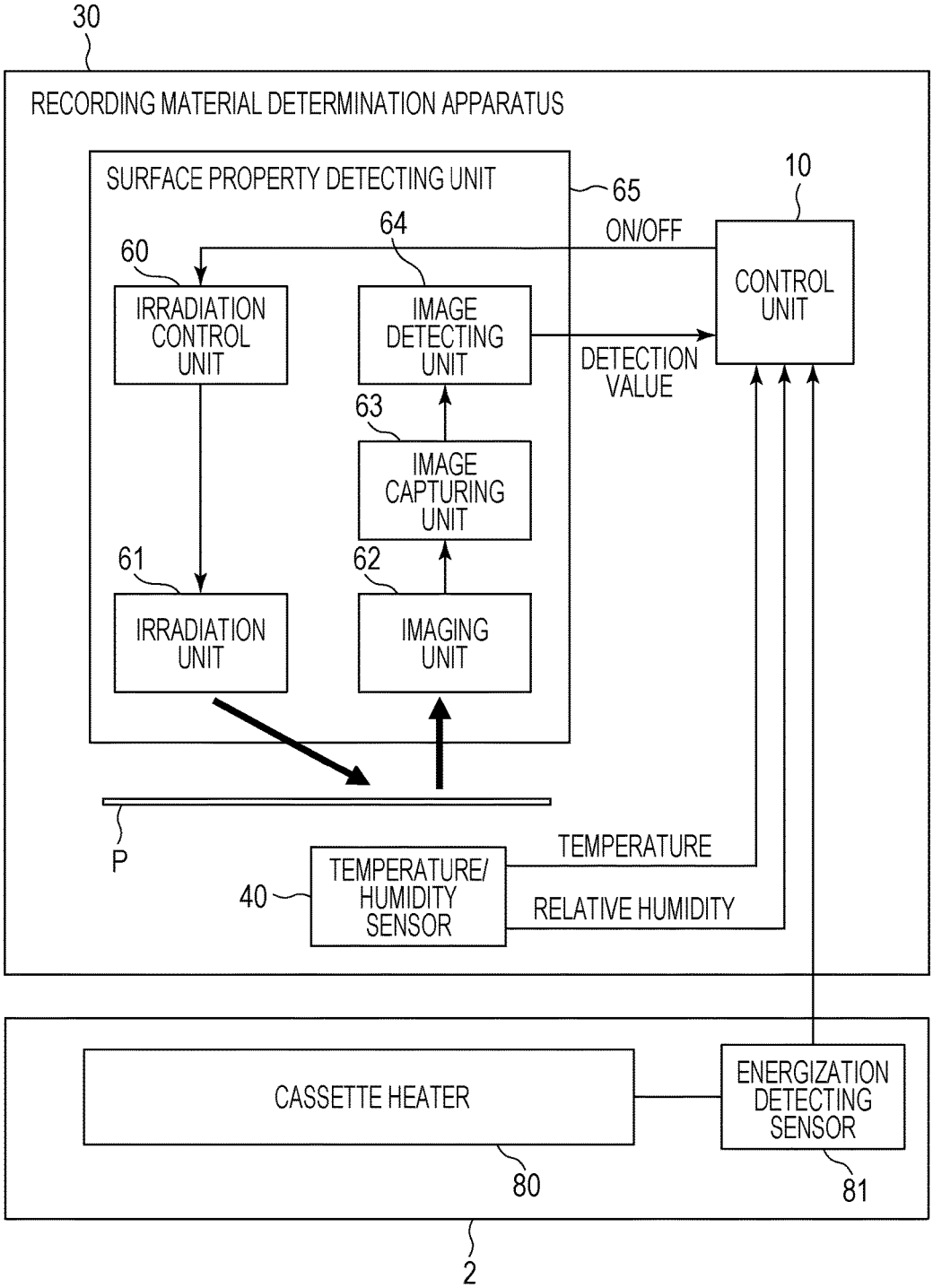
FIG. 7 illustrates an example of a recording material determination apparatus to which Embodiment 2 is applicable.

FIG. 7 illustrates an example of a configuration of the recording material determination apparatus 30 and a configuration of the feeding cassette 2 in the present embodiment. A surface property detecting unit 65 is constituted by an irradiation control unit 60, an irradiation unit 61 (light emitting unit), an imaging unit 62, an image capturing unit 63 (light receiving unit), and an image detecting unit 64. The irradiation unit 61 is constituted by a member such as an LED and irradiates a surface of the sheet P with light. The imaging unit 62 receives reflection light of light irradiated from the irradiation unit 61, which is reflected by the surface of the sheet P, and forms an image. The image capturing unit 63 is constituted by a member such as a CMOS sensor and captures an image of the light formed by the imaging unit 62.

When the sheet P is conveyed to an installation position of the surface property detecting unit 65 at a constant speed, the control unit 10 transmits, to the irradiation control unit 60, a signal for starting irradiation. The irradiation unit 61 irradiates the surface of the sheet P with light under control of the irradiation control unit 60. The image capturing unit 63 captures an image of the light irradiated to the sheet P via the imaging unit 62. The captured image is an image of the surface of the sheet P and output to the image detecting unit 64. At this time, by pressing a component (not illustrated) such as a roller against the sheet P from a back side of the sheet P, a conveyance position of the sheet P is within a range of a focal distance for the imaging. The surface image obtained here varies depending on a surface property (unevenness) of the sheet P. The image detecting unit 64 calculates the surface property of the sheet P from a ratio of shadow occupied in the surface image and outputs an analog voltage as a detection result of the surface property of the sheet P to the AD port of the control unit 10. Here, as the detection result of the surface property of the sheet P, information about the surface property, such as a difference value between a maximum concentration value and a minimum concentration value that are included in data of the surface image, may be used, for example. The control unit 10 receives an output of the reception detecting unit 43 by an AD port of a CPU (not illustrated). The AD port of the control unit 10 is able to detect a voltage with a resolution of 256 division levels by using a power supply voltage input to the control unit 10 as a reference and performs conversion into a dec value by detecting how many times the voltage input to the AD port is greater than the resolution, and decides the dec value as a detection value. For example, when the power supply voltage of the control unit 10 is 3.3 V and the dec value is 128, the voltage input to the AD port is 1.65 V. Note that, though the description has been given with use of the 256 division levels in the present embodiment, this is merely an example. After deciding the detection value, the control unit 10 gives an instruction to stop the operation to the irradiation control unit 60. Moreover, the control unit 10 detects a temperature and a relative humidity by the temperature/humidity sensor 40 and obtains a moisture content around the printer 1.

A relation between the surface property and the paper type will be described. In general, with a sheet P having a smooth surface property such as coated paper, a ratio of a shadow occupied in the surface image is small, and conversely, with a sheet P having a rough surface property such as bond paper, a ratio of a shadow occupied in the surface image is large. Thus, as an example, a detection value of the surface property that is deiced by the control unit 10 with respect to an output when the surface property detecting unit 65 detects a sheet P having a smooth surface property is associated with 100 dec. Therefore, when the detection value is less than 100 dec, the type of the sheet P is determined as coated paper, and when the detection value is not less than 100 dec, the type of the sheet P is determined as plain paper.

Subsequently, the paper type and the image forming condition will be described. In general, a resistance value of the sheet P having a smooth surface property such as coated paper is relatively low. Accordingly, a transfer condition, such as a transfer current, may be changed to transfer a toner agent, compared with a rough sheet P such as bond paper. Moreover, as for the sheet P having a smooth surface property such as coated paper, a required fixing temperature is lower and a time required for fixing is shorter than those of the rough sheet P such as bond paper. A fixing condition, such as a fixing temperature, a fixing time, or a conveyance speed, may be changed accordingly. Therefore, in order to refine an image quality, an appropriate image forming condition (a transfer condition or a fixing condition) may be set in accordance with the paper type.

Next, the moisture content of the sheet P and the image forming condition will be described. The resistance value or the surface property of the sheet P changes depending on the moisture content and the image forming condition may be set accordingly. Moreover, the change in the resistance value of the sheet P according to the moisture content varies depending on the paper type. Thus, the image forming condition according to the paper type and the moisture content is set, so that optimum image formation is able to be performed.

<Correction of Detection Value when Cassette Heater 80 is not Energized>

Influence that the moisture content has on determination of a paper type will be described. When the moisture content of the sheet P is high, a moisture content contained in fibers constituting the sheet P increase, so that a gap between the fibers is filled and a surface becomes smooth. On the other hand, when the moisture content is low, the moisture content contained in fibers constituting the sheet P decreases, so that a gap between the fibers is expanded and the surface becomes rough. Therefore, when the paper type is determined based on a detection value of the surface property that changes due to the moisture content, there is a possibility that the paper type of the sheet P is erroneously determined. Accordingly, correction may be performed in accordance with the moisture content of the sheet P to obtain a predetermined determination accuracy.

The moisture content of the sheet P is correlated with a moisture content in the air near the sheet P, that is, a moisture content in the air near the feeding cassette 2 on which the sheet P is placed. Moreover, in the present example, the moisture content in the air near the feeding cassette 2 is handled as being the same as the moisture content in the air around the printer 1, which is obtained by the temperature/humidity sensor 40. In the present embodiment, description will be given by taking an absolute moisture content which is obtained based on a temperature and a humidity as an example of the moisture content, and an environment in which the absolute moisture content is about 11.5 g (corresponding to a temperature of 25° C. and a humidity of 50% RH) is set as a reference environment. Note that, in the present embodiment, description will be given by taking the absolute moisture content as an example, but there is no limitation thereto as long as the moisture content contained in the sheet P is able to be estimated. As an example, the moisture content contained in the sheet P is able to be estimated from a moisture content obtained based on the relative humidity. For example, in a case of use within a temperature range in which change in the moisture content is small, the moisture content contained in the sheet P may be estimated based on the relative humidity around the sheet P, and the estimation is able to be performed with accuracy equivalent to that of the absolute moisture content obtained based on a temperature and a humidity.

Figure 8:
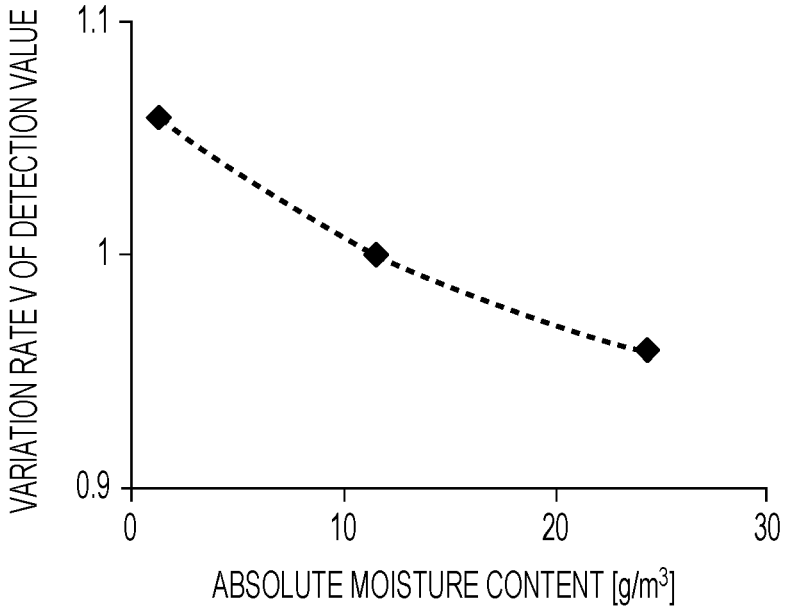
FIG. 8 is a graph indicating an example of a relation between a moisture content and a detection value according to Embodiment 2.

Next, influence that variation in the moisture content detected based on the detection result of the temperature/humidity sensor 40 has on the detection value of the surface property detecting unit 65 will be described with use of experimental results of the inventors, which are illustrated in FIG. 8. As described above, in order to estimate the moisture content contained in the sheet P, in the present embodiment, the moisture content that is obtained by the temperature/humidity sensor 40 is used as an example. A horizontal axis of FIG. 8 indicates the moisture content based on the detection result of the temperature/humidity sensor 40. A vertical axis of FIG. 8 indicates a variation rate V of the detection value of the surface property detecting unit 65 when the environment in which the moisture content is about 11.5 g (corresponding to a temperature of 25° C. and a humidity of 50% RH) is set as a reference environment. As described above, the detection value of the surface property also increases or decreases in accordance with increase or decrease of the moisture content. As illustrated in FIG. 8, the moisture content and the detection value are expressed by a quadratic curve. An approximate formula of the variation rate V is able to be calculated based on FIG. 8. Accordingly, when the moisture content is able to be detected, by using of the approximate formula of the variation rate V to multiply the detection value by the variation rate V that is estimated, the detection value is able to be corrected to a detection value under the same reference environment.

It is found that, as an example, the detection value of the sheet P illustrated in FIG. 8 under an environment in which the moisture content is 24 g is about 0.96 times as much as the detection value under the environment in which the moisture content is 11.5 g. Accordingly, in order to convert the detection value into a detection value under the reference environment in which the moisture content is 11.5 g, the detection value may be divided by 0.96. That is, by dividing the detection value by the variation rate V, the detection value is corrected to a value under the reference environment in which the moisture content is about 11.5 g (corresponding to a temperature of 25° C. and a humidity of 50% RH). In the case of the present embodiment, by substituting the moisture content around the printer 1, which is obtained by the temperature/humidity sensor 40, in the following approximate formula 2 obtained based on the quadratic curve of FIG. 8, the variation rate V of the detection value is obtained.

$$\text{Variation rate } V = 0.0002 \times (\text{moisture content}[g])^2 - 0.01 \times \text{moisture content}[g] + 1.08 \qquad \text{approximate formula 2}$$

Here, the approximate formula 2 of the variation rate V is an example in the present embodiment and may be appropriately set in accordance with a detection characteristic of the surface property detecting unit 65. Moreover, as described above, in the present embodiment, the moisture content in the air near the feeding cassette 2 is handled as being the same as the moisture content in the air around the printer 1, which is obtained by the temperature/humidity sensor 40. In general, a placement portion such as the feeding cassette 2, a manual feeding tray (not illustrated), or an optional feeding cassette (not illustrated) is provided at a place that is not significantly influenced by a heat source such as a power supply or a driving source of the printer 1. Thus, it is able to be considered that the moisture content in the air near the feeding cassette 2 is almost equal to that around the printer 1.

<Correction of Detection Value when Cassette Heater 80 is Energized>

On the other hand, when the cassette heater 80 is energized, a temperature and a humidity near the feeding cassette 2 are different from a temperature and a humidity near the printer 1. That is, a moisture content of the sheet P that is estimated from the moisture content which is obtained from the temperature and the humidity near the printer 1 is different from an actual moisture content of the sheet P. Accordingly, the moisture content near the feeding cassette 2 is not able to be handled as being the same as the moisture content near the printer 1 as in the case of the correction of the detection value when the cassette heater 80 is not energized as described above. Then, when determining that the cassette heater 80 is energized based on the detection result of the energization detecting sensor 81, the control unit 10 calculates the moisture content near the feeding cassette 2 based on fixed temperature and humidity information that is stored in the control unit 10 in advance. The fixed temperature and humidity information is a value that is examined and decided in advance and is a temperature and a humidity near the feeding cassette 2 when the cassette heater 80 is used under an environment close to an actual use environment. For example, when the cassette heater 80 is used under a high-temperature and high-humidity environment (32.5° C. and 80%), "the temperature of 38° C. and the humidity of 58%" are stored in a storage unit such as a ROM in advance as the fixed temperature and humidity information. The control unit 10 calculates the moisture content near the feeding cassette 2 from the fixed temperature and humidity information and calculates the variation rate V based on the moisture content. Moreover, information of a moisture content itself obtained from the fixed temperature and humidity information may be stored instead of the fixed temperature and humidity information. Since subsequent correction of the detection value is the same as the correction of the detection value when the cassette heater 80 is not energized, description thereof will be omitted.

As above, in the present embodiment, the detection value is corrected based on the moisture content obtained by the detection result of the temperature/humidity sensor 40, but a correcting method is not limited as long as a result of determination of a paper type according to a moisture content is able to be obtained. For example, a correction target may not be the detection value, and a similar effect is achieved also by changing a threshold of the detection value to determine a paper type. An example of the threshold corresponds to 100 dec that is a threshold of plain paper and coated paper. By increasing or decreasing the threshold of 100 dec based on the moisture content that is detected, it is possible to determine a paper type according to the moisture content without correcting the detection value. As a method other than the method of correcting the detection value or the threshold, it is also possible to store a table, which indicates a relation between the moisture content near the sheet P and the detection value, in the control unit 10 to determine the paper type from the moisture content and the detection value that are obtained, and an effect similar to that of the present embodiment is able to be obtained. An example of the table includes a table in which, when the detection value is 98 dec and the moisture content is 11.5 g, the paper type is determined as plain paper, and when the detection value is 98 dec and the moisture content is 5 g, the paper type is determined as coated paper.

<Explanation of Flowchart>

Figure 9:
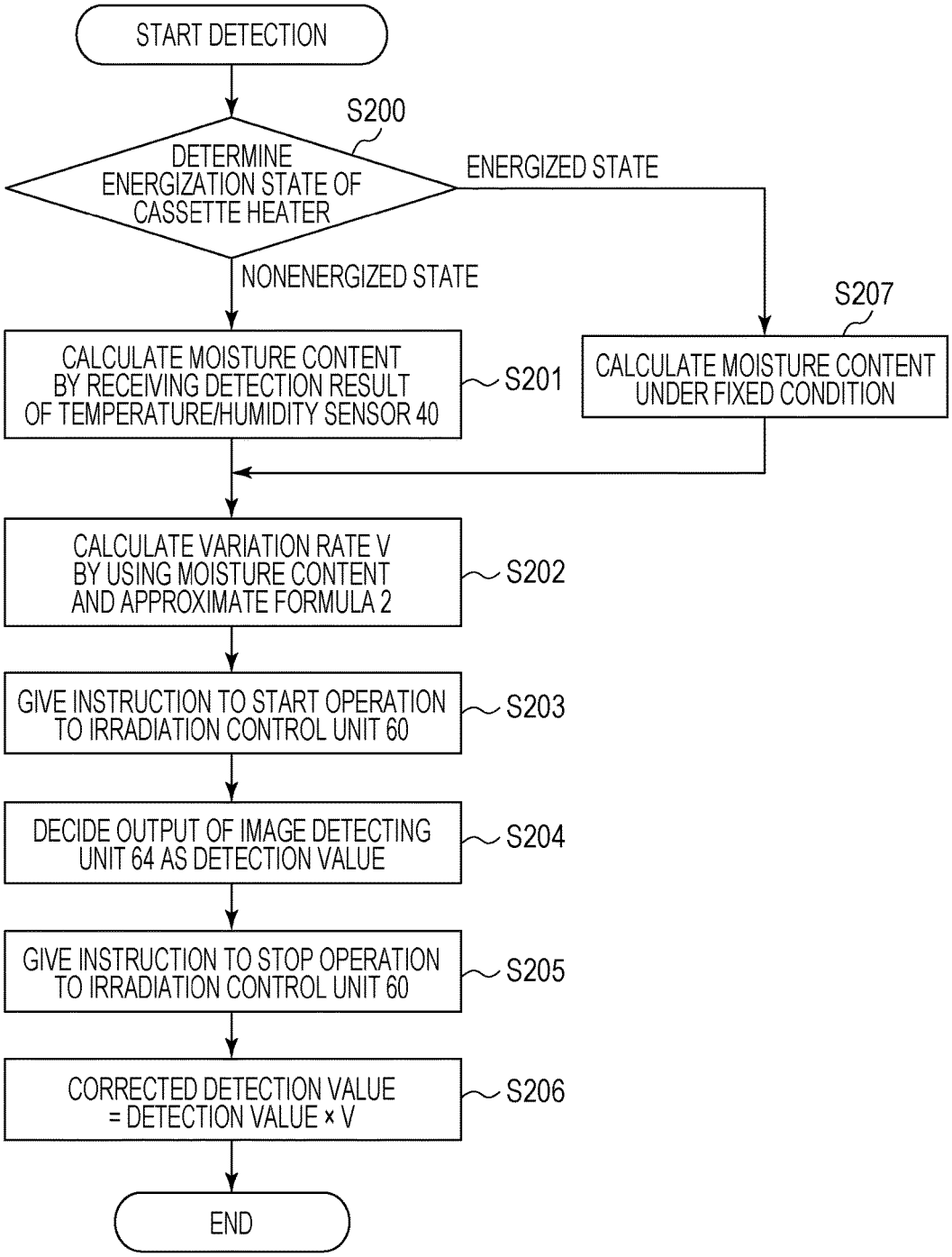
FIG. 9 illustrates an example of a flowchart of a method of determining a recording material according to Embodiment 2.

An operation of the present embodiment will be described with a flowchart of FIG. 9. The control unit 10 determines an energization state of the cassette heater 80 based on a detection result of the energization detecting sensor 81 (S200). When determining that the cassette heater 80 is in an nonenergized state, the control unit 10 obtains a moisture content from a detection result of the temperature/humidity sensor 40 (S201), and calculates a variation rate V of a surface property from the obtained moisture content by using the approximate formula 2 (S202). Next, the control unit 10 gives an instruction to start an operation to the irradiation control unit 60 (S203), and receives an output of the image detecting unit 64 by the AD port (S204). After deciding the received output as a detection value, the control unit 10 gives an instruction to stop the operation to the irradiation control unit (S205). By dividing the detection value by the variation rate V, the control unit 10 obtains the value as a corrected detection value (S206). When determining that the cassette heater 80 is in an energized state at S200, the control unit 10 obtains a moisture content under a fixed condition stored in advance (S207), and calculates a variation rate V of a surface property from the obtained moisture content by using the approximate formula 2 (S202). Since steps after the step (S203) are performed in the same manner as the flow when the cassette heater 80 is determined to be in the nonenergized state, description thereof will be omitted.

According to the present embodiment, the configuration and the operation described above achieve the following effect. The recording material determination apparatus 30 corrects change in the detection value of the surface property of the sheet P based on the moisture content obtained from the detection result of the temperature/humidity sensor 40, so that it is possible to refine accuracy of determination of a paper type. The printer 1 that includes the recording material determination apparatus 30 is able to appropriately set an image forming condition according to the determined paper type, so that it is possible to refine an image quality. Additionally, as an example of a method of obtaining an optimum image forming condition, a relation of a moisture content, a detection value, and an image forming condition is saved in the control unit 10, and with the obtained relation of the moisture content and the detection value, it is also possible to decide the image forming condition without determining a paper type.

In the present embodiment, the temperature/humidity sensor 40 that detects the moisture content near the printer 1 is used to obtain the moisture content near the feeding cassette 2, but the method is not limited thereto as long as the moisture content near the feeding cassette 2 is obtained.

In the present embodiment, the control unit 10 determines an energization state of the cassette heater 80 based on the detection result of the energization detecting sensor 81, but the method is not limited thereto. For example, there is also a method in which a user or a service person inputs a state of the cassette heater 80 to the control unit 10. By this method, the control unit 10 may determine the energization state of the cassette heater 80 based on information that is input.

Additionally, the configuration in which the recording material determination apparatus 30 includes the grammage detecting unit 31 has been described in Embodiment 1, and the configuration in which the recording material determination apparatus 30 includes the surface property detecting unit 65 has been described in Embodiment 2, but there is no limitation thereto. Embodiment 1 and Embodiment 2 may be combined to provide such a configuration that the recording material determination apparatus 30 includes both the grammage determining unit 31 and the surface property determining unit 65 and determines the type of sheet P from the grammage and the surface property of the sheet P.

[Embodiment 3]

<Configuration of Recording Material Determination Apparatus>

The printer 1 to which the present embodiment is applicable has the same configuration as that of the printer 1 described in Embodiment 1 excluding the recording material determination apparatus 30 and the cassette heater 80. Accordingly, in the present embodiment, description of the recording material determination apparatus 30 and the cassette heater 80 will be given and description of other common parts will be omitted.

Figure 10:
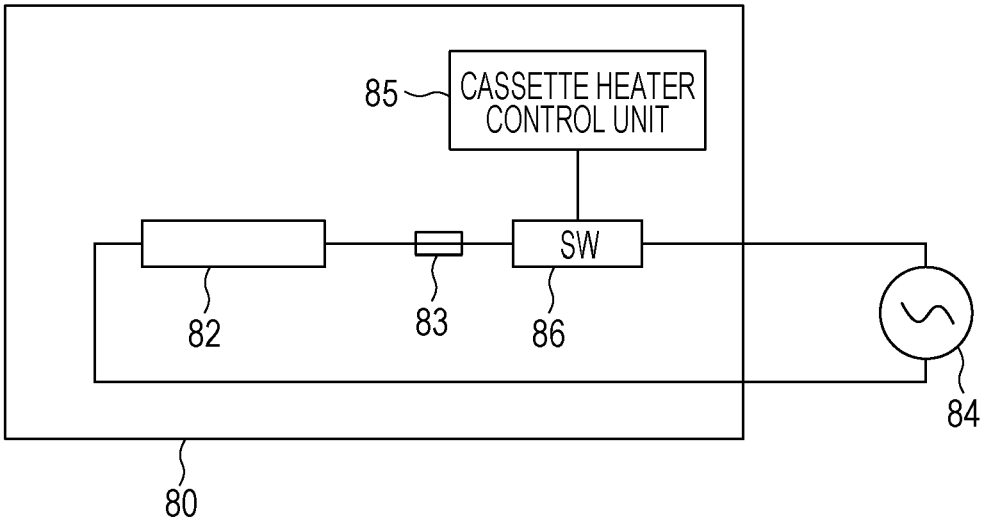
FIG. 10 illustrates an example of a cassette heater according to Embodiment 3.

FIG. 10 illustrates an example of the cassette heater 80 to which the present embodiment is applicable. The cassette heater 80 is constituted by the resistor 82, the fuse 83, a switch 86, and a cassette heater control unit 85 and connected to the external power supply 84 such as a commercial power supply. The cassette heater control unit 85 controls the switch 86 to thereby control power that is supplied to the resistor 82. The cassette heater control unit 85 is connected to the control unit 10 of the recording material determination apparatus 30 described below and controls the cassette heater 80 in response to a command from the control unit 10.

Figure 11:
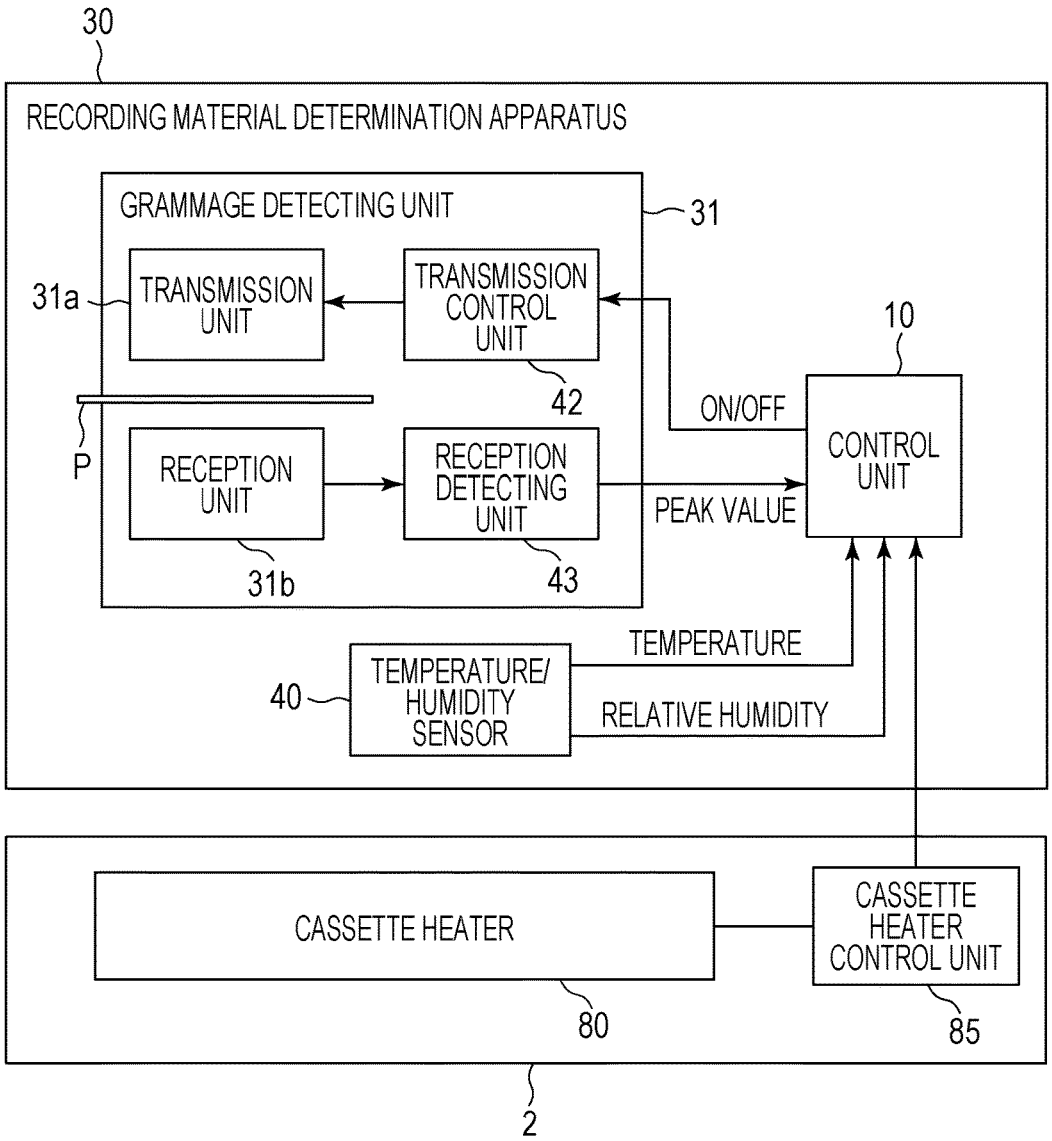
FIG. 11 illustrates an example of a recording material determination apparatus of Embodiment 3.

FIG. 11 illustrates an example of the recording material determination apparatus 30 to which the present embodiment is applicable. The control unit 10 controls the cassette heater control unit 85. Thereby, the control unit 10 is able to count an ON time of the cassette heater 80. Since other parts are the same as those of the recording material determination apparatus 30 of Embodiment 1, description thereof will be omitted.

<Change in Moisture Content with Time>

Figure 12:
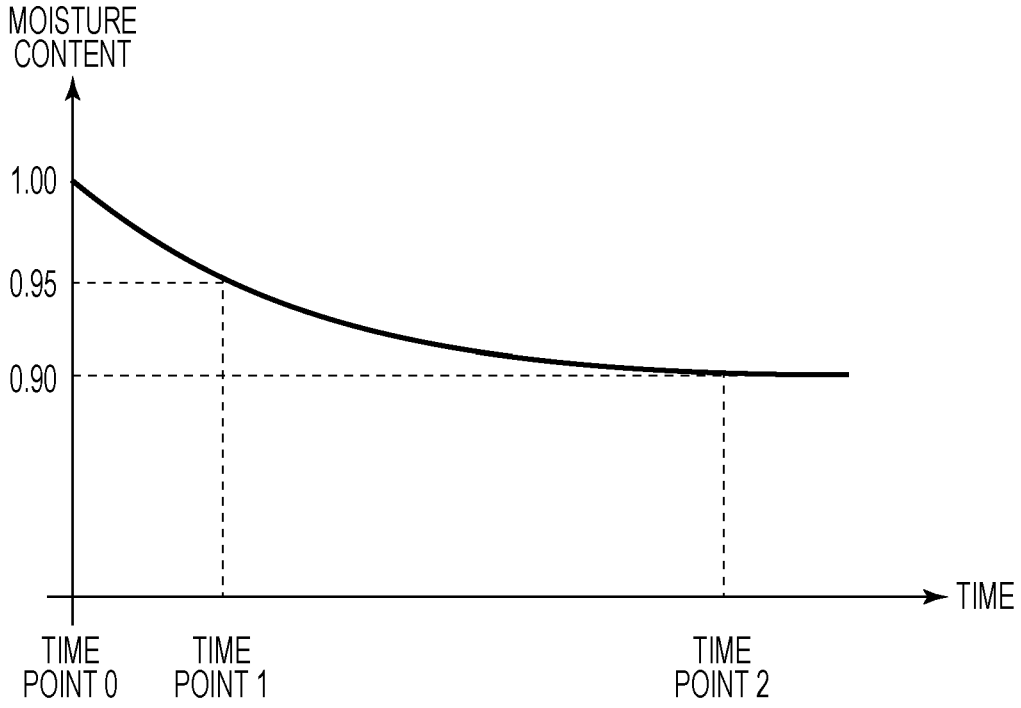
FIG. 12 is a graph indicating an example of change in a moisture content with time according to Embodiment 3.

FIG. 12 illustrates an example of change in a moisture content of the sheet P with time. In a graph of FIG. 12, a horizontal axis indicates time elapsed after the cassette heater 80 is turned on, and a vertical axis indicates a moisture content of the sheet P. At a time point 0, the sheet P placed on the feeding cassette 2 adequately absorbs moisture in the air. When the cassette heater 80 is energized at the time point 0, the humidity inside the feeding cassette 2 is reduced and the moisture content of the sheet P is thus reduced. When a certain time is elapsed (a time point 2), the change in the moisture content of the sheet P is brought into an equilibrium state. For example, when the moisture content at the time point 0 is 1.0, the moisture content changes to 0.95 at a time point 1 and the moisture content changes to 0.9 at the time point 2.

<Correction of Change with Time>

Since an operation of the recording material determination apparatus 30 in the present embodiment is the same as that of the recording material determination apparatus 30 of Embodiment 1, description of the operation will be omitted. A method of correcting a detection value is different from that in Embodiment 1, so that the method of correcting the detection value will be described.

In the control unit 10, change in a moisture content with time elapsed after the cassette heater 80 illustrated in FIG. 12 is energized is stored as a formula or a table. The formula or the table is decided from an experimental result when the cassette heater 80 is used under an environment in which the printer 1 is actually used. The control unit 10 counts the time elapsed after the cassette heater 80 is energized and estimates the moisture content of the sheet P based on the counted time.

As an example, an example of an operation for determining a type of the sheet P under a high-temperature and high-humidity environment (32.5° C. and 80%) will be described. An environment around the printer 1 when the cassette heater 80 is started to be energized (time point 0) is the high-temperature and high-humidity environment (32.5° C. and 80%) and the moisture content at the time is 27.8 g. When the time elapsed after the cassette heater 80 is energized is the time point 1, by a curved line of FIG. 12, the moisture content at the time point 1 is calculated as 27.8 g×0.95=26.41 g, and the variation rate V is calculated from the approximate formula 1 by using a value of the calculated moisture content. According to FIG. 5, the variation rate V at the time is able to be calculated as about 1.033. That is, in the present embodiment, the moisture content of the sheet P is estimated based on the moisture content around the printer 1 immediately before the cassette heater 80 is started to be energized and the time elapsed after the cassette heater 80 is started to be energized.

<Explanation of Flowchart>

Figure 13:
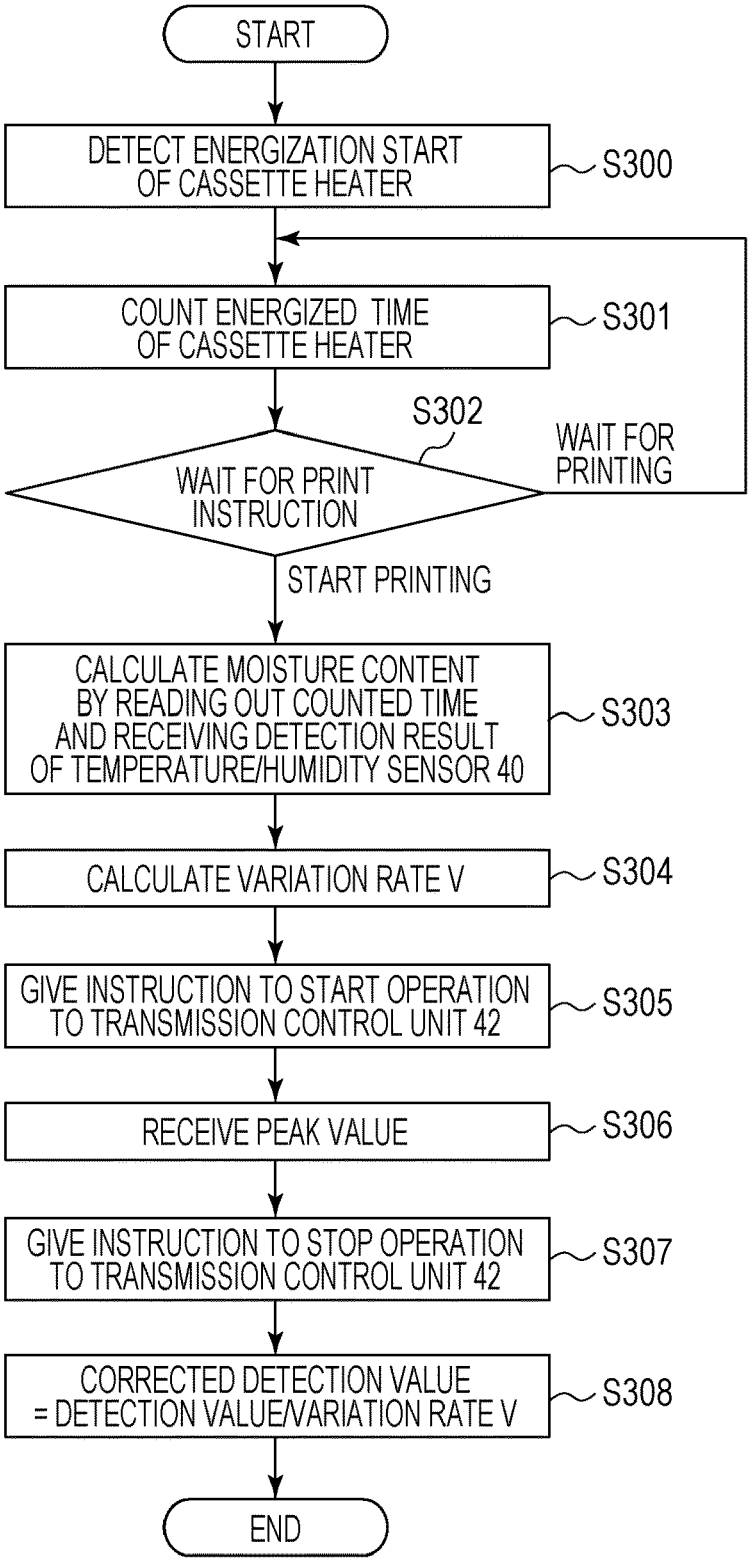
FIG. 13 illustrates an example of a flowchart of a method of determining a recording material according to Embodiment 3.

An operation of the present embodiment will be described with a flowchart of FIG. 13. The control unit 10 detects an energization start of the cassette heater 80 (S300) and counts an energized time of the cassette heater 80 (S301). After that, the control unit 10 waits for a print instruction (S302), and when starting printing, progresses processing to S303. When printing does not start, the control unit 10 counts the energized time continuously. At S303, the control unit 10 calculates a moisture content from the energized time of the cassette heater 80 and a detection result of the temperature/humidity sensor 40 by the aforementioned method. Then, the control unit 10 calculates the variation rate V based on the calculated moisture content (S304). Next, the control unit 10 gives an instruction to start an operation to the transmission control unit 42 (S305) and receives a peak value of a received waveform of an ultrasonic wave transmitted through the sheet P from the reception detecting unit 43 (S306). Then, the control unit 10 gives an instruction to stop the operation to the transmission control unit 42 (S307). The peak value of the received waveform is detected by the AD port of the control unit 10, and input to the control unit 10 as a detection value of the grammage detecting unit 31. The control unit 10 divides the detection value by the variation rate V and obtains the value as a corrected detection value (S308).

In the present embodiment, a method of calculating the variation rate of the moisture content based on the time elapsed after the cassette heater 80 is energized has been described. Similarly, by calculating the variation rate of the moisture content based on a time elapsed after the cassette heater 80 is not energized, it is possible to refine accuracy of detection of the moisture content when the cassette heater 80 is not energized.

In the present embodiments, though the paper type is determined based on the detection value of the grammage of the sheet P, the determination method is not limited thereto. For example, as described in Embodiment 2, the paper type may be determined based on a detection value of a surface property of the sheet P. Additionally, by combining both the detection value of a grammage and the detection value of a surface property, the paper type may be determined.

In the aforementioned embodiments, though a laser printer is cited as an example, an image forming apparatus to which the disclosure is applicable is not limited thereto and a printer having another printing method such as an inkjet printer or a copier may be used.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-167760 filed Aug. 31, 2017, which is hereby incorporated by reference herein in its entirety.

What is claimed is:

1. An image forming apparatus comprising:

a heat generation member configured to heat a recording material placed on a placement portion;

an image forming unit configured to form an image on the recording material conveyed from the placement portion;

a detecting unit configured to perform detection for information about a characteristic of the recording material and obtain detection result;

a measuring unit configured to perform measurement for information about a moisture content around the image forming apparatus and obtain measured information; and a control unit configured to set an image forming condition for the image forming unit based on a detection result obtained by the detecting unit, the measured information obtained by the measuring unit immediately before energization to the heat generation member is started, and a time elapsed after the energization to the heat generation member is started.

2. The image forming apparatus according to claim 1, wherein the control unit further is configured to obtain a moisture content contained in the recording material placed on the placement portion from the measured information obtained by the measuring unit or the information stored in a storage unit, and to correct the detection result obtained by the detecting unit based on the moisture content obtained by the control unit.

3. The image forming apparatus according to claim 1, wherein the measuring unit is a sensor configured to measure a temperature and a humidity around the image forming apparatus.

4. The image forming apparatus according to claim 1, wherein the detecting unit includes a transmission unit configured to transmit an ultrasonic wave to the recording material and a reception unit configured to receive the ultrasonic wave transmitted from the transmission unit and attenuated through the recording material, and wherein the control unit further is configured to determine a grammage of the recording material based on an amplitude value of the ultrasonic wave received by the reception unit.

5. The image forming apparatus according to claim 1, wherein the detecting unit includes an irradiation unit configured to irradiate the recording material with light and a light receiving unit configured to receive the light irradiated from the irradiation unit and reflected by the recording material, and wherein the control unit further is configured to determine a surface property of the recording material based on the reflected light received by the light receiving unit.

6. An image forming apparatus comprising:

a heat generation member configured to heat a recording material placed on a placement portion;

an image forming unit configured to form an image on the recording material conveyed from the placement portion;

a detecting unit configured to perform detection for information about a characteristic of the recording material and obtain detection result;

a measuring unit configured to perform measurement for information about a moisture content around the image forming apparatus and obtain measured information;

a storage unit configured to store information about a moisture content around the placement portion in a state where the heat generation member is energized; and a control unit configured to set an image forming condition for the image forming unit, wherein, in a case where the heat generation member is not energized, the control unit sets the image forming condition based on the detection result obtained by the detecting unit and the measured information obtained by the measuring unit, and wherein, in a case where the heat generation member is energized, the control unit sets the image forming condition based on the detection result obtained by the detecting unit and the information stored in the storage unit.

7. The image forming apparatus according to claim 6, wherein the control unit further is configured to obtain a moisture content contained in the recording material placed on the placement portion from the measured information obtained by the measuring unit or the information stored in the storage unit, and to correct the detection result obtained by the detecting unit based on the moisture content obtained by the control unit.

8. The image forming apparatus according to claim 6, wherein the measuring unit is a sensor configured to measure a temperature and a humidity around the image forming apparatus.

9. The image forming apparatus according to claim 6, wherein the detecting unit includes a transmission unit configured to transmit an ultrasonic wave to the recording material and a reception unit configured to receive the ultrasonic wave transmitted from the transmission unit and attenuated through the recording material, and wherein the control unit further is configured to determine a grammage of the recording material based on an amplitude value of the ultrasonic wave received by the reception unit.

10. The image forming apparatus according to claim 6, wherein the detecting unit includes an irradiation unit configured to irradiate the recording material with light and a light receiving unit configured to receive the light irradiated from the irradiation unit and reflected by the recording material, and wherein the control unit further is configured to determine a surface property of the recording material based on the reflected light received by the light receiving unit.

11. A method for an image forming apparatus having a heat generation member configured to heat a recording material placed on a placement portion, an image forming unit configured to form an image on the recording material conveyed from the placement portion, and a storage unit, the method comprising:

forming, via the image forming unit, an image on the recording material conveyed from the placement portion;

performing detection for information about a characteristic of the recording material and obtaining detection result;

performing measurement for information about a moisture content around the image forming apparatus and obtaining measured information;

storing, in a storage unit, information about a moisture content around the placement portion in a state where the heat generation member is energized; and setting an image forming condition for the image forming unit, wherein, in a case where the heat generation member is not energized, setting includes setting the image forming condition based on the obtained detection result and the obtained measured information, and wherein, in a case where the heat generation member is energized, setting includes setting the image forming condition based on the obtained detection result and the information stored in the storage unit.

12. A non-transitory computer-readable storage medium storing a program to cause an image forming apparatus, having a heat generation member configured to heat a recording material placed on a placement portion, an image forming unit configured to form an image on the recording material conveyed from the placement portion, and a storage unit, to perform a method, the method comprising:

forming, via the image forming unit, an image on the recording material conveyed from the placement portion;

performing detection for information about a characteristic of the recording material and obtaining detection result;

performing measurement for information about a moisture content around the image forming apparatus and obtaining measured information;

storing, in a storage unit, information about a moisture content around the placement portion in a state where the heat generation member is energized; and setting an image forming condition for the image forming unit, wherein, in a case where the heat generation member is not energized, setting includes setting the image forming condition based on the obtained detection result and the obtained measured information, and wherein, in a case where the heat generation member is energized, setting includes setting the image forming condition based on the obtained detection result and the information stored in the storage unit.

* * * * *